United States Patent [19]

Freeman

[11] Patent Number: 5,007,470

[45] Date of Patent: Apr. 16, 1991

[54] PURSE WITH REMINDER DEVICE

[76] Inventor: Carol A. Freeman, 16000 Pemberville Rd., Pemberville, Ohio 43450

[21] Appl. No.: 515,186

[22] Filed: Apr. 27, 1990

[51] Int. Cl.[5] ..... A45C 1/02; A45C 15/02

[52] U.S. Cl. ..... 150/114; 150/145; 206/45.34

[58] Field of Search ..... 150/102-106, 150/112-114, 149, 117, 145; 206/45.34; 190/102, 902, 903, 111; 383/106

[56] References Cited

U.S. PATENT DOCUMENTS

| | | | |
|---|---|---|---|
| 501,728 | 7/1893 | Nathan | 150/106 |
| 1,181,080 | 4/1916 | Lowenstein | 150/106 X |
| 1,416,690 | 5/1922 | Cohen | 150/106 X |
| 3,955,609 | 5/1976 | Siegel | 150/114 X |
| 4,164,308 | 8/1979 | Gautier | 150/112 X |
| 4,243,340 | 1/1981 | MacGregor | 190/102 X |
| 4,309,784 | 1/1982 | Cohen | 206/45.34 X |
| 4,570,688 | 2/1986 | Williams | 150/102 X |
| 4,580,667 | 4/1986 | Herwood | 150/113 X |
| 4,669,587 | 6/1987 | Zitt | 206/45.34 X |
| 4,739,809 | 4/1988 | Adams | 150/114 X |

FOREIGN PATENT DOCUMENTS

| | | | |
|---|---|---|---|
| 2406969 | 6/1979 | France | 150/104 |
| 2629794 | 10/1989 | France | 150/103 |
| 223823 | 10/1924 | United Kingdom | 150/105 |

*Primary Examiner*—Sue A. Weaver

*Attorney, Agent, or Firm*—H. Jay Spiegel

[57] ABSTRACT

The present invention relates to a purse having a reminder device therewith. The purse includes as an exterior portion thereof a flap. The flap includes a closeable pocket which is formed by a transparent portion removably attachable to a backing portion of the flap. The closeable pocket, as an exterior portion of the purse, permits viewing of a reminder device placed therein by a user of the purse.

3 Claims, 1 Drawing Sheet

PURSE WITH REMINDER DEVICE

BACKGROUND OF THE INVENTION

The present invention relates to a purse having a reminder device therewith. In the prior art, purses, handbags and organizing devices are known. The following prior art is known to Applicant:

U.S. Pat. No. 4,164,308 to Gautier discloses a ladies handbag which is adapted to be carried with improved security. The teachings of this patent are only generally related to the present invention.

U.S. Pat. No. 4,580,667 to Herwood discloses an organizing device having transparent sheets therein. The organizing device includes a rotatable assembly of hinge elements that is designed to be inserted into a piece of luggage and to be used to store a plurality of different items. The teachings of this patent are different from those of the present invention in that the organizing device of Herwood does not teach of fairly suggest all of the features of the present invention including a purse having a reminder device therewith.

SUMMARY OF THE INVENTION

The present invention relates to a purse having a reminder device therewith. The present invention includes the following interrelated aspects and features:

(A) In a first aspect, a purse is provided having a plurality of compartments therein. Attached to the purse is a flap which may be draped over one of the compartments in the purse. The flap when draped over one of the compartments of the purse forms an exterior portion of the purse which is readily visible to a user.

(B) The flap includes a closeable pocket which is formed by a transparent portion, the transparent portion being removably attachable to the flap. The removable attachable feature of the transparent portion permits insertion of a reminder device in the closeable pocket. The closeable pocket, being located on the exterior of the purse, permits viewing of the reminder device through the transparent sheet by a user.

(C) The reminder device may include memos, shopping lists, items to be returned to a store, and the like.

Accordingly, it is a first object of the present invention to provide a purse having a reminder device therewith.

It is a further object of the present invention to provide a purse having an exterior portion thereof with a closeable pocket which permits viewing of a reminder device therein by a user.

It is a still further object of the present invention to provide a closeable pocket which includes a transparent portion which is removably attachable to an exterior portion of a purse.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
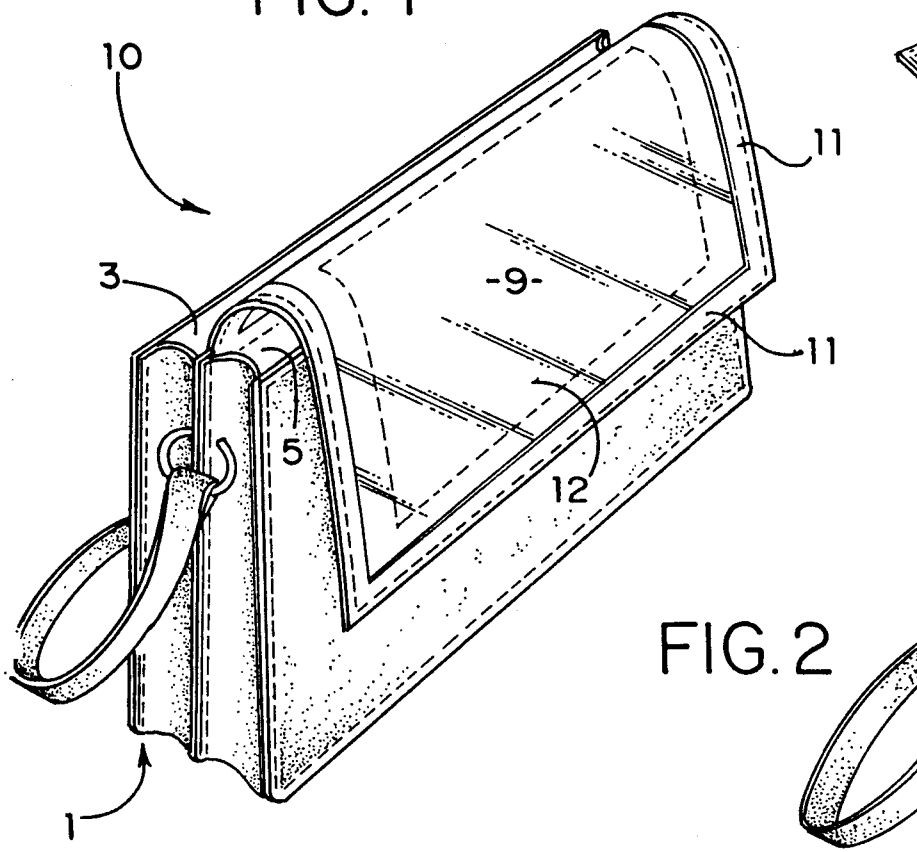
FIG. 1 shows a perspective view of the purse and reminder device.

With reference to FIG. 1 firstly, the present invention is generally designated by the reference numeral 10 and is seen to include a purse 1 with a pair of compartments 3 and 5 therein. The purse 1 also includes a flap 7 which is shown draped over the compartment 5 of the purse 1. The flap 7 acts as the reminder device of the present invention in that it includes a transparent portion 9 thereon.

Figure 2:
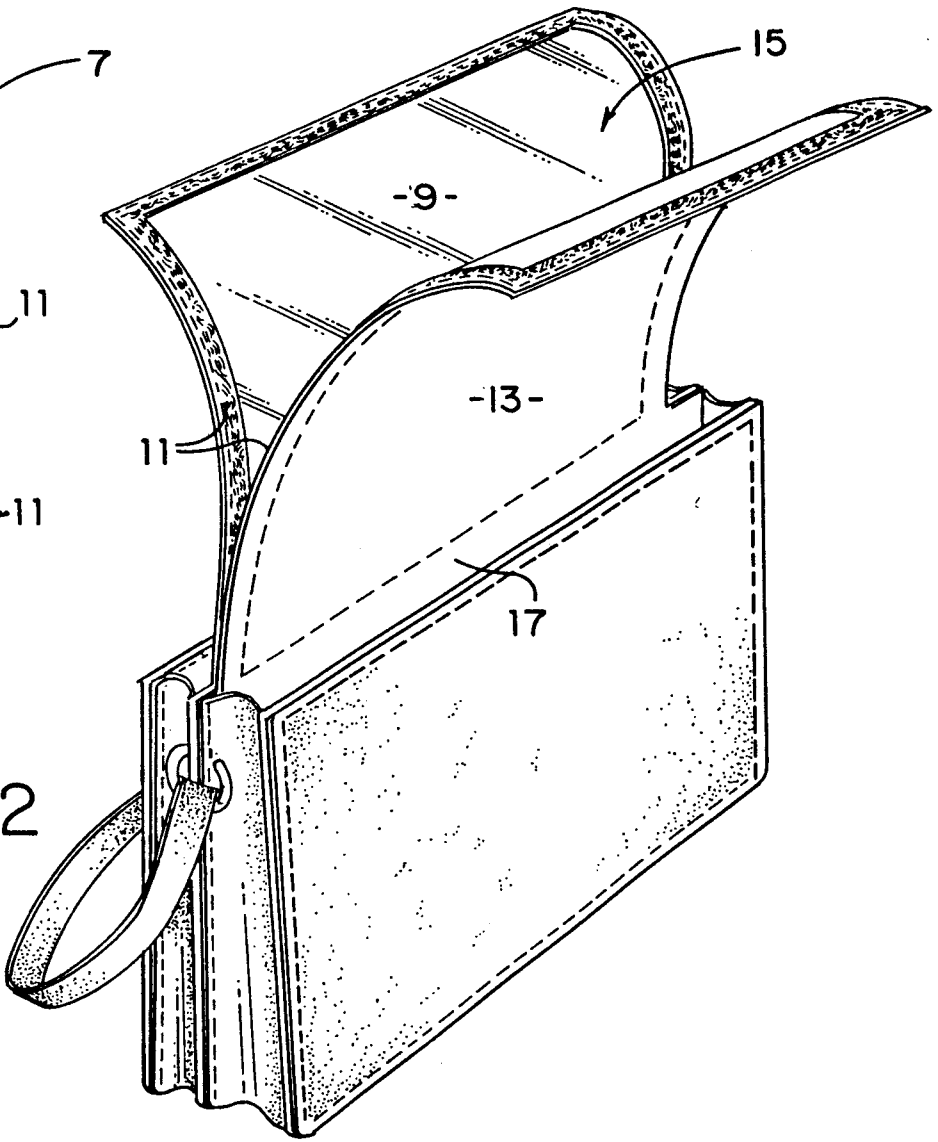
FIG. 2 shows a perspective view showing the reminder device in an open configuration.

With reference to FIG. 2 and FIG. 1 again, the transparent portion 9 is removably attachable to the flap backing portion 13 by hook and pile fastening means 11. The hook and pile fastening means 11 permits the transparent portion 9 to be removed from the backing portion 13, thereby creating a pocket 15 which allows insertion of a reminder device therein.

An exemplary use of the reminder device is illustrated in FIG. 1 with a memo 12 shown in phantom which is readily viewable by a user of the purse 1.

With reference to FIG. 2 again, the flap 7 is shown attached to the purse 1 at the reference numeral 17. Although the backing portion 13 is shown as an integral part of the purse 1, the flap 7 may also be removably attachable from the purse 1. Furthermore, other types of closure means may be utilized to permit the transparent portion 9 to be removably attachable to the backing portion 13, for example, snaps, fasteners, or the like.

It should be understood by those skilled in the art that other designs of purses having one or more compartments therein may be utilized in combination with the reminder device of the present invention. For example, a purse having only one compartment may be utilized with the reminder device.

As such, an invention has been disclosed in terms of a preferred embodiment thereof which fulfills each and every one of the objects of the present invention as set forth hereinabove and provides a new and improved purse having a reminder device therewith of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An improved purse having a reminder device incorporated therewith comprising:

(a) a purse having at least one compartment with an access opening;

(b) a flap having means for attachment to said purse, such that said flap is moveable to a position in overlying relation to said access opening;

(c) said flap including:

(i) a transparent portion;

(ii) a backing portion; and (iii) means to removably attach at least a portion of said transparent portion to said backing portion, said transparent portion and said backing portion forming a chamber viewable through said transparent portion when said flap is in said position;

(d) said chamber receiving a reminder message facing said transparent portion.

2. The invention of claim 1, wherein said means to removably attach at least a portion of said transparent portion to said backing portion includes hook and pile fastening means.

3. The invention of claim 1, wherein said flap is attached to said purse adjacent a said compartment to facilitate said flap covering said access opening of a said compartment.

* * * * *